US005431077A

United States Patent [19]

Murakami

[11] Patent Number: 5,431,077

[45] Date of Patent: Jul. 11, 1995

[54] PAPER CUTTING DEVICE USING A MOVABLE CUTTING WHEEL

[75] Inventor: Fuminori Murakami, Tokyo, Japan

[73] Assignee: NEC Corporation, Tokyo, Japan

[21] Appl. No.: 91,132

[22] Filed: Jul. 14, 1993

[30] Foreign Application Priority Data

Jul. 14, 1992 [JP] Japan ..... 4-186397

[51] Int. Cl.[6] ..... B26D 1/18; B26D 5/08

[52] U.S. Cl. ..... 83/162; 83/105; 83/487; 83/508; 83/614

[58] Field of Search ..... 83/485, 487, 508, 614, 83/105, 162, 165, 150; 346/24; 358/304; 400/621

[56] References Cited

U.S. PATENT DOCUMENTS

| | | | |
|---|---|---|---|
| 2,599,601 | 6/1952 | Axworthy | 83/508 X |
| 3,447,409 | 6/1969 | Lewis | 83/485 |
| 3,981,215 | 9/1976 | Granger et al. | 83/614 X |
| 3,986,419 | 10/1976 | Cleghorn | 83/455 X |
| 4,117,753 | 10/1978 | Friddle, Sr. et al. | 83/614 X |
| 4,197,774 | 4/1980 | Singh et al. | 83/614 X |
| 4,355,794 | 10/1982 | Costigan | 83/614 X |
| 4,383,458 | 5/1983 | Kitai et al. | 83/614 X |
| 4,535,664 | 8/1985 | Raymond | 83/162 |
| 4,907,014 | 3/1990 | Tzeng et al. | 83/614 X |

FOREIGN PATENT DOCUMENTS 876386 5/1953 Germany .

*Primary Examiner*—Eugenia Jones

*Attorney, Agent, or Firm*—Sughrue, Mion, Zinn, Macpeak & Seas

[57] ABSTRACT

A paper cutting device provided in a facsimile machine, copier, printer, or the like for cutting paper discharged from a roll at a predetermined length. The paper cutting device includes a stationary cutter (2), a movable cutter (5) and movable carriage (3) to which the movable cutter is secured and which is movable along the stationary cutter (2) so that the stationary cutter in cooperation with the movable cutter cut the paper. The stationary cutter (2) extends in the lateral direction of the paper which is supplied to the paper cutting device. The carriage (3) includes a front plow portion (33*a*) for guiding the paper to a cutting position where the stationary cutter (2) and the movable cutter (5) overlap. When the carriage (3) traverses to cut the paper, the paper is urged toward the cutting position by the front plow portion and is cut. Thereafter, the cut portion of the paper is separated from the carriage 3 at a curved concave portion 33*d* of the carriage.

11 Claims, 8 Drawing Sheets

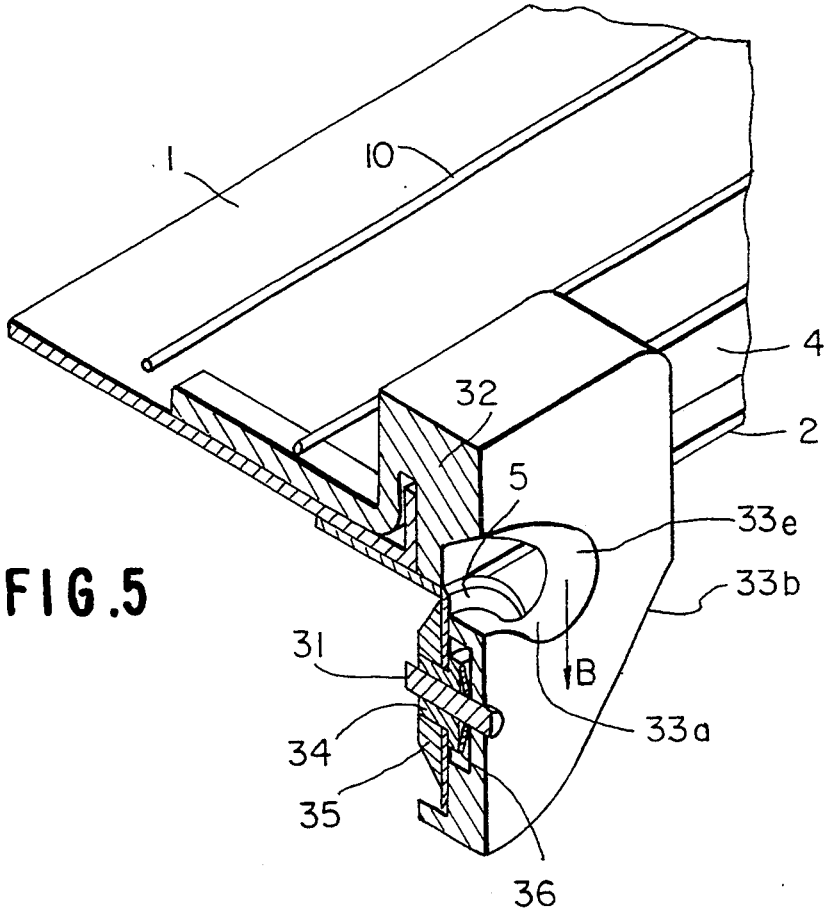
FIG.5
FIG.7
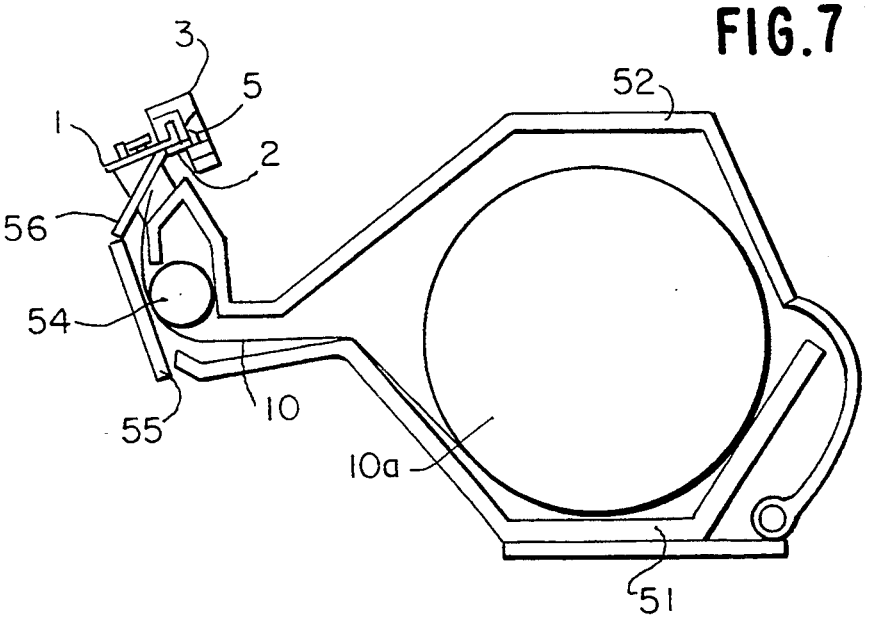

PAPER CUTTING DEVICE USING A MOVABLE CUTTING WHEEL

BACKGROUND OF THE INVENTION

1. Field of the Invention

The present invention relates to a paper cutting device provided in a facsimile machine, copier, printer, or the like for cutting paper discharged from a roll at a predetermined length, and more particularly, to a paper cutting device including an elongated stationary cutter and a movable cutter which is movable along the stationary cutter to thereby cut the paper.

2. Description of the Related Art

Conventional copiers, printers, facsimile machines and the like include a paper cutting device for cutting a paper discharged from a roll page by page. A conventional paper cutting device is illustrated in FIG. 1. Such a device includes an elongated stationary cutter 21 having a stationary cutting edge and a movable cutter 22 having a movable cutting edge and being movable along the stationary cutter while being urged thereagainst so that the cutting edges cooperate to cut the paper. Specifically, a rotary cutting wheel 22 is used as the movable cutter and is positioned so that its peripheral cutting edge slightly overlaps the cutting edge of the stationary cutter 21 thereby cutting the paper as it is discharged from the roll.

The cutting wheel 22 is rotatably mounted to a carriage 23 which is movable on and along a guide rail 24*a* of an elongated guide plate 24 disposed in parallel to the stationary cutter 23. There is a narrow gap 25 between the elongated guide plate 24 and the stationary cutter 21 in which the paper, discharged from the roll, is inserted to hold the paper while the cutting wheel 22 is moved along the stationary cutter 21.

In order to move the cutting wheel along the guide rail 24*a*, the carriage 23 is fixed to a wire 27 which is disposed between pulleys 28*a* and 28*b*. The pulley 28*a* is coupled to a motor 29 to transmit a rotation force from the motor 29 to the wire 27. A frame 26 holds the stationary cutter 21, guide plate 24, pulleys 28*a*, 28*b* and motor 29, as illustrated in FIG. 1.

The paper is cut in the following manner. As noted above, the paper 10 is inserted into the gap 25 from the back of the frame 26 so that the paper is retained therein during a cutting operation. When the cutting wheel carriage 23 moves from one end of the guide rail 24*a* to the other end, the cutting wheel 22 in cooperation with the stationary cutter 21 cuts the paper 10.

FIG. 2 shows a printing mechanism of a facsimile receiver which uses the conventional paper cutting device of FIG. 1. A thermal sensing paper roll 10*a* is disposed in a case 41 which is fixed on a base 40. A cover 42 is located over the case 41. A platen roller 44 is coupled to the cover 42 and contacts a thermal head 43 with the paper disposed therebetween so as to record information on the paper 10 discharged from the thermal sensing paper roll 10*a*. During the printing operation, the platen roller 44 rotates to transmit the paper 10 via paper guide plates 45 into the gap 25 defined by the stationary cutter 22 and the guide plate 24 and the paper is cut, as shown in FIG. 3.

The problem associated with such an arrangement is that when a paper jam occurs in the narrow gap 25, it is extremely difficult to remove the jammed portion of the paper. Furthermore, when a new sheet is installed in the printer or the like, it is difficult and time consuming to hand feed the end of the paper through the narrow gap by hand or using a feed roller.

In more detail, when the paper roll 10*a* is set on the case 41 after removing the cover 42, the paper 10 has to be inserted between the guide plates 45 and then fed into the gap 25. However, when feeding the paper, the end of the paper 10 is sometimes obstructed at the entrance of the gap 25 because the gap 25 is too narrow. Moreover, when the paper jams in the gap 25, it is difficult to remove the jammed paper from the gap. On the other hand, if the gap 25 is widened in an effort to overcome the above problems associated with inserting the paper and unjamming the paper, the paper cannot be cut properly because the paper 10 floats and tends to curl in the gap during cutting, which causes the paper to jam.

SUMMARY OF THE INVENTION

An object of the present invention is to provide a paper cutting device which allows the paper to be easily fed without being inserted into a narrow gap and which enables any paper jams to be easily corrected.

A paper cutting device according to the present invention comprises a stationary cutter extending in a lateral direction of the paper, a movable cutter which is movable along the stationary cutter in such a manner that the cutting edge of the movable cutter slightly overlaps the cutting edge of the stationary cutter at a cutting position, a movable carriage to which the movable cutter is secured, the carriage including a plow portion for guiding the paper toward the cutting position to facilitate the cutting of the paper and moving means for moving the movable carriage along the stationary cutter.

Another paper cutting device according to the present invention comprises a stationary cutter extending along a lateral direction of the paper and having a stationary cutting edge, a movable cutter movable along the stationary cutter and having a movable cutting edge which, in cooperation with the stationary cutting edge, cuts said paper at a cutting position, and a movable carriage including an arm disposed in front of an edge of the stationary cutter for rotatably supporting said movable cutter. The arm is provided with a concave portion through which a cut portion of the paper is fed to separate the cut portion from the uncut portion. The movable carriage is moved along the stationary cutter by moving means.

BRIEF DESCRIPTION OF THE DRAWINGS

The above and other objects, features and advantages of the present invention will become more apparent from the following detailed description taken with the accompanying drawings in which:

FIG. 5 is a sectional view taken along line 5—5 of FIG. 4;

FIG. 7 is a sectional view of the recording device of FIG. 6;

DETAILED DESCRIPTION OF THE PREFERRED EMBODIMENTS

Figure 1:
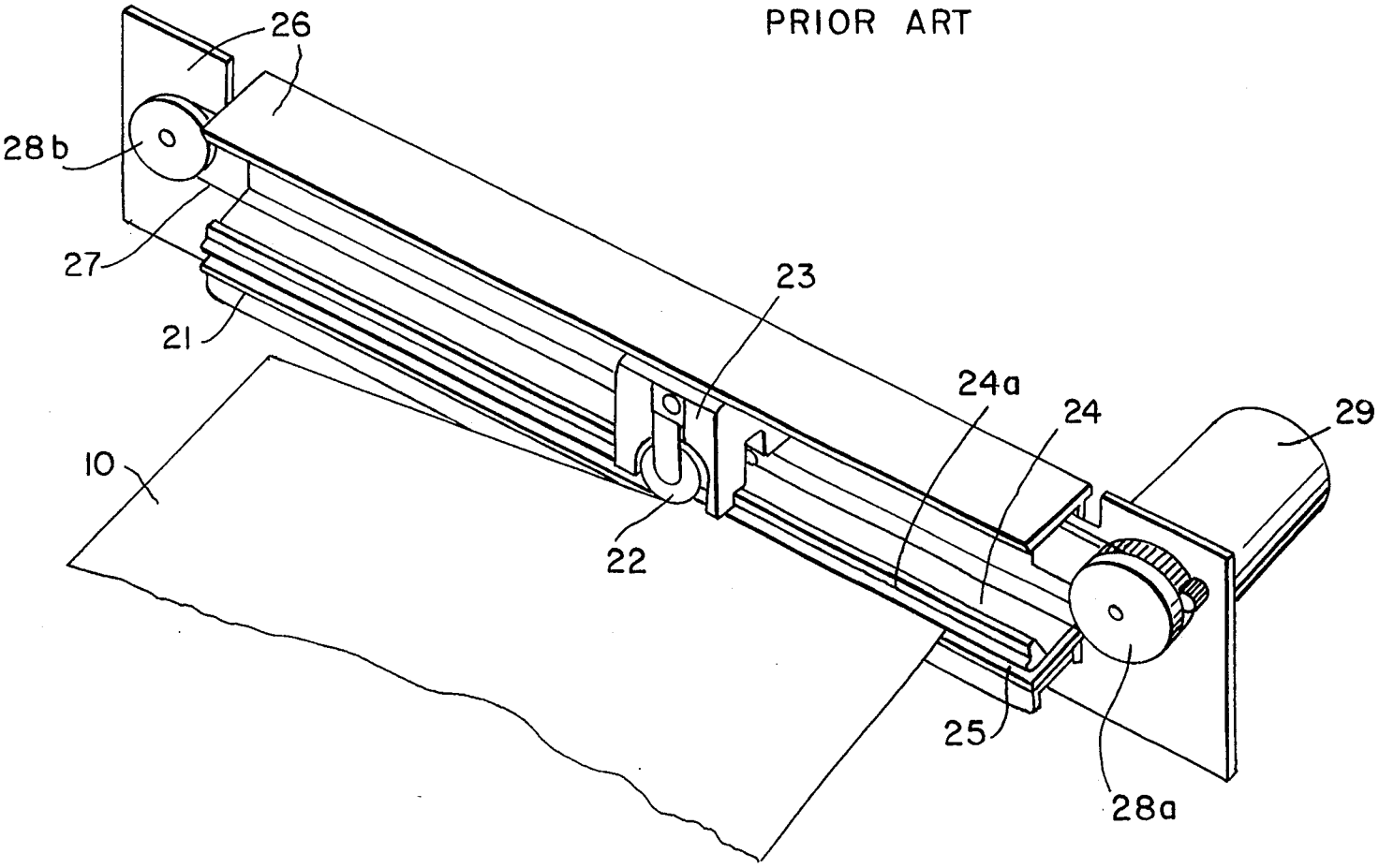
FIG. 1 PRIOR ART
FIG. 1 is a perspective view of a conventional paper cutting device.
Figure 2:
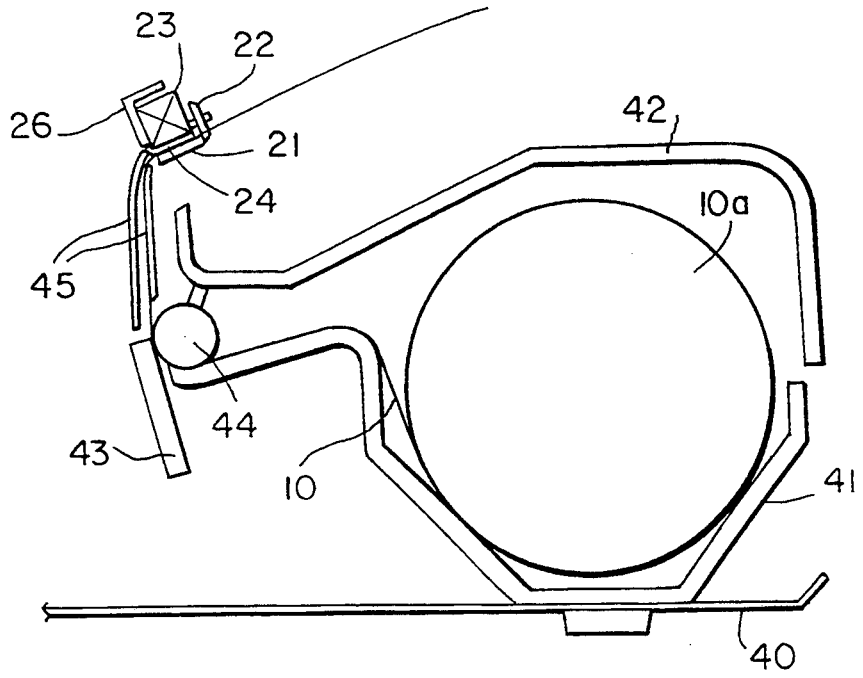
FIG. 2 PRIOR ART
FIG. 2 is a sectional view of a recording deride of a facsimile machine which includes the conventional paper cutting device of FIG. 1.
Figure 3:
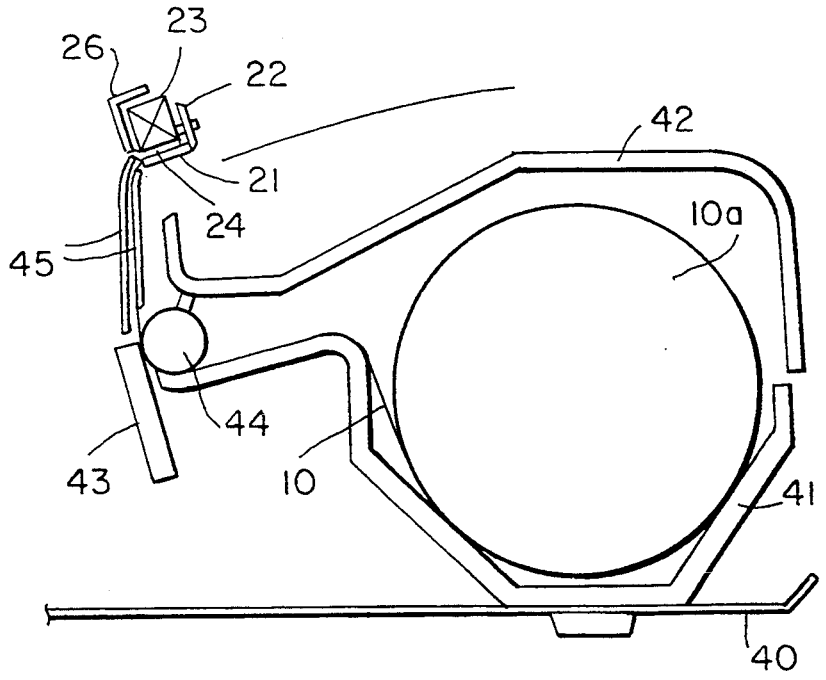
FIG. 3 PRIOR ART
FIG. 3 is a sectional view for showing a cutting operation of the recording device of FIG. 2.
Figure 4:
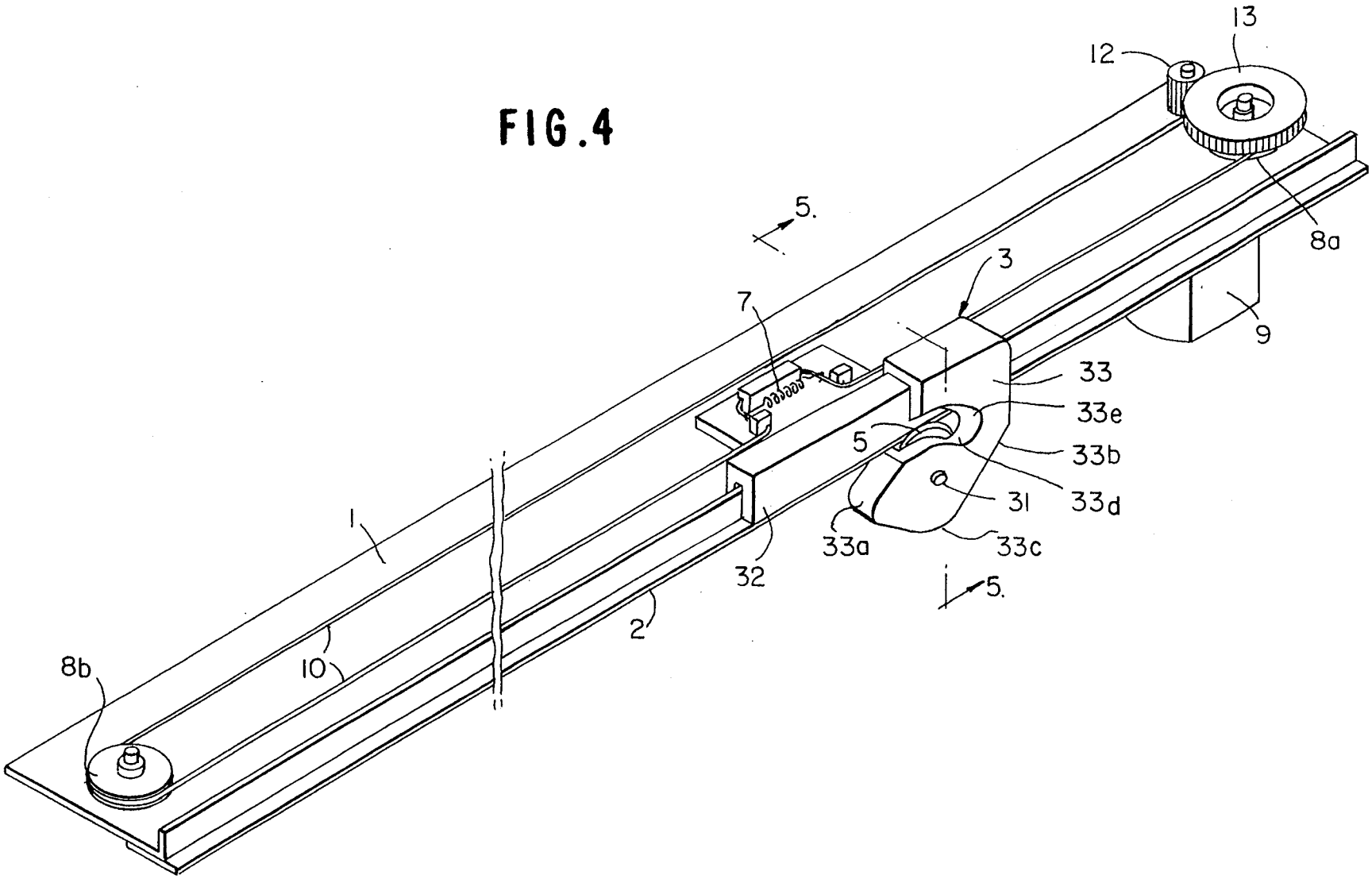
FIG. 4 is a perspective view of a paper cutting device according to a preferred embodiment according to the present invention.

FIG. 4 is a perspective view of a paper cutting device of a preferred embodiment of the present invention and FIG. 5 is sectional view taken along line 5—5 of FIG. 4. In FIG. 4, an elongate, straight stationary cutter 2 having a cutting edge is positioned on a side portion of a flat cutter frame 1, and is affixed thereto by a two-sided adhesive tape or similar affixing material so as to extend parallel to the longitudinal direction of the frame 1. An edge of the cutter frame 1 is bent upwardly to form an upright guide rail 4 disposed above the stationary cutting member 2. A carriage 3 is connected to the guide rail 4 by a holder 32 which is slidably disposed on the guide rail 4 so that the carriage can be moved in the longitudinal direction of the stationary cutter 2.

The carriage 3 includes the slidable holder 32 and a generally L-shaped arm 33 secured to the slidable holder 32 and hanging downwardly therefrom. A cutting wheel 5 is rotatably supported thereon and constitutes the movable cutter which, in cooperation with the stationary cutter 2, cuts the paper as described below. The arm 33 includes a front plow portion 33*a*, rear plow portion 33*b* and bottom plow portion 33*c* and defines a curved concave portion 33*d* illustrated in FIG. 4. The plow portions 33*a*–33*c* are disposed below the stationary cutter 2. A pin 31 is fixed to the arm 33 proximate the plow portions and has a bearing 34 rotatably disposed thereon, as shown in FIG. 5. The cutting wheel 5 is coupled to the bearing 34 so as to be rotatable about the pin 31 via the bearing 34. The edge of the cutting wheel 5 slightly overlaps the cutting edge of the stationary cutter 2.

Referring to FIG. 5, a pressure plate 35 is integrally secured to the cutting wheel 5 so as to be rotatable therewith. The outer edge of the pressure plate 35 is pressed upright against the bottom of the stationary cutting member 2 by the arm 33. When the carriage 3 is moved in a reciprocating motion, a rotational force acts on the cutting wheel 5 due to the friction between the bottom of the stationary cutting member 2 and the pressure plate 35. Thus, the reciprocating motion of the carriage causes the cutting wheel 5 to rotate. A resilient plate 36 is inserted in the pin 31 and the plate 36 pushes the bearing 34 to urge the edge of the cutting wheel 5 to the stationary cutting member 2.

As illustrated in FIG. 4, the front plow portion 33*a* is disposed forwardly of the cutting position between the stationary cutter 2 and cutting wheel 5 and inclines downwardly. The curved concave portion 33*d* is located slightly rearwardly of the cutting position and is curved downward. A curved surface 33*e*, which partially defines the curved concave portion 33*d*, faces in the direction of arrow B in FIG. 5, and is inclined with respect to the stationary cutter 2. The curved concave portion 33*d* and the curved surface 33*e* are provided for the purpose of separating the paper cut at the cutting position between the stationary cutter 2 and the cutting wheel 5 and urging the cut portion of the paper toward the outside of the carriage 3.

Referring again to FIG. 4, two pulleys 8*a* and 8*b* are mounted on opposite ends of the cutter frame 1 in the longitudinal direction of the stationary cutter 2. The pulley 8*a* is rotated by a motor 9 via a pinion gear 12 mounted on an output shaft of the motor 9 and a gear 13. A wire 10 circumscribes the pulleys 8*a* and 8*b* and is held under tension by a coil spring 7 to serve as a medium for driving the cutting wheel carriage 3. The slidable holder 32 of the carriage 3 is connected to the wire 10 at a predetermined position. When the motor 9 is energized, the rotation of the motor 9 is transmitted to the pulley 8*a* via the pinion gear 12 and gear 13. As a result, the pulley 8*a* causes the wire 10 and, therefore, the carriage 3 to reciprocate back and forth along the guide rail 4.

The following is an explanation of the operation of the cutting device. First, the carriage 3 is located at a home position which is located at the right-hand side (motor side) of the cutter frame 1. A paper (not shown) is fed under the cutter frame 1 to the stationary cutting member 2. When the carriage 3 moves from the home position and the stationary cutter 2 and rotary cutting wheel 5 start to cut the paper, the front plow portion 33*a* guides a side edge of the paper toward the cutting position where the stationary cutter 2 and cutting wheel 5 overlap. After the paper is cut at the cutting position, the cut paper is passed through the curved concave portion 33*d* so that it contacts the curved surface 33*e* and is fed outwardly of the arm 33. As soon as the carriage 3 reaches the leftmost point on the cutter frame, the motor 9 is reversed to move the wire 10 in the opposite direction. Consequently, the carriage 3 is returned to the home position. At this instant, the rear plow portion 33*b* and bottom plow portion 33*c* push the cut sheet downwardly to prevent the cut paper from jamming during the return movement of the carriage 3.

Figure 6:
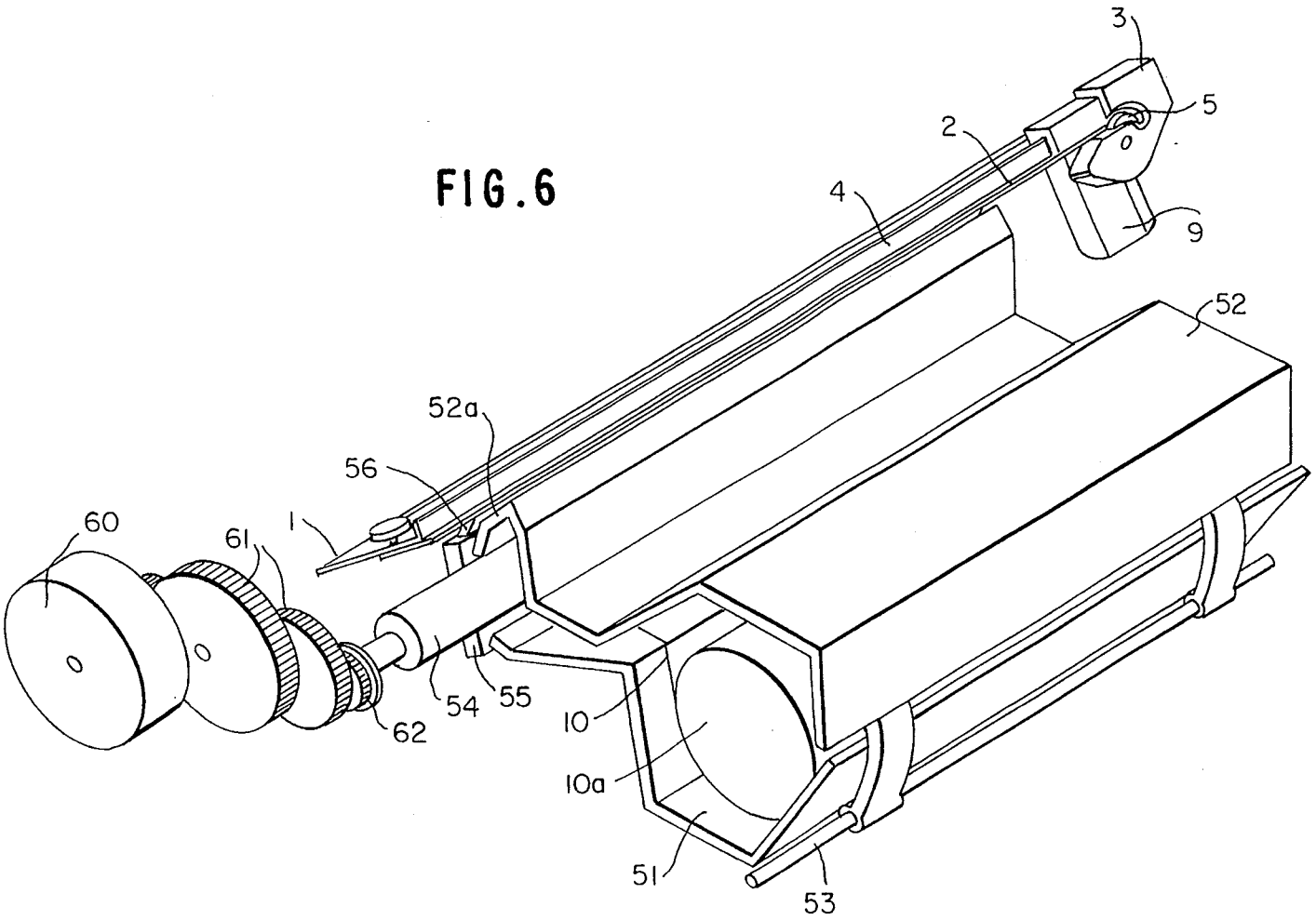
FIG. 6 is a perspective view of a recording device of a facsimile machine which includes the paper cutting device of FIG. 4.

FIG. 6 is a perspective view of a printing device used in a facsimile machine which includes the paper cutting device of FIG. 4, and FIG. 7 is a sectioned view of the printing device of FIG. 6.

The thermal sensing paper roll 10*a* is disposed in a case 51. A cover 52 is located over the case 51, and one end of the cover 52 is connected to a bar 53 so that the cover 52 can pivot about the bar 53 between opened and closed positions. A platen roller 54 is coupled to the cover 52 and rotates under the cover 52. Although a coupling mechanism between the platen roller 54 and the cover 52 is not shown in the Figures, various support members and bearings are used as the coupling mechanism. The specific construction of the coupling mechanism would be obvious to a person of ordinary skill in the art.

The platen 54 presses the paper unwound from the paper roll 10*a* against a thermal head 55 to record information on the paper and transmits the paper 10 to a guide plate 56. One end of the platen roller 54 is provided with a gear 62 which is rotated by a motor 60 via a gear 61. The guide plate 56 faces a guide portion 52*a* of the cover 52 to guide the paper 10 under the cutter frame 1, as best illustrated in FIG. 7.

Figure 8:
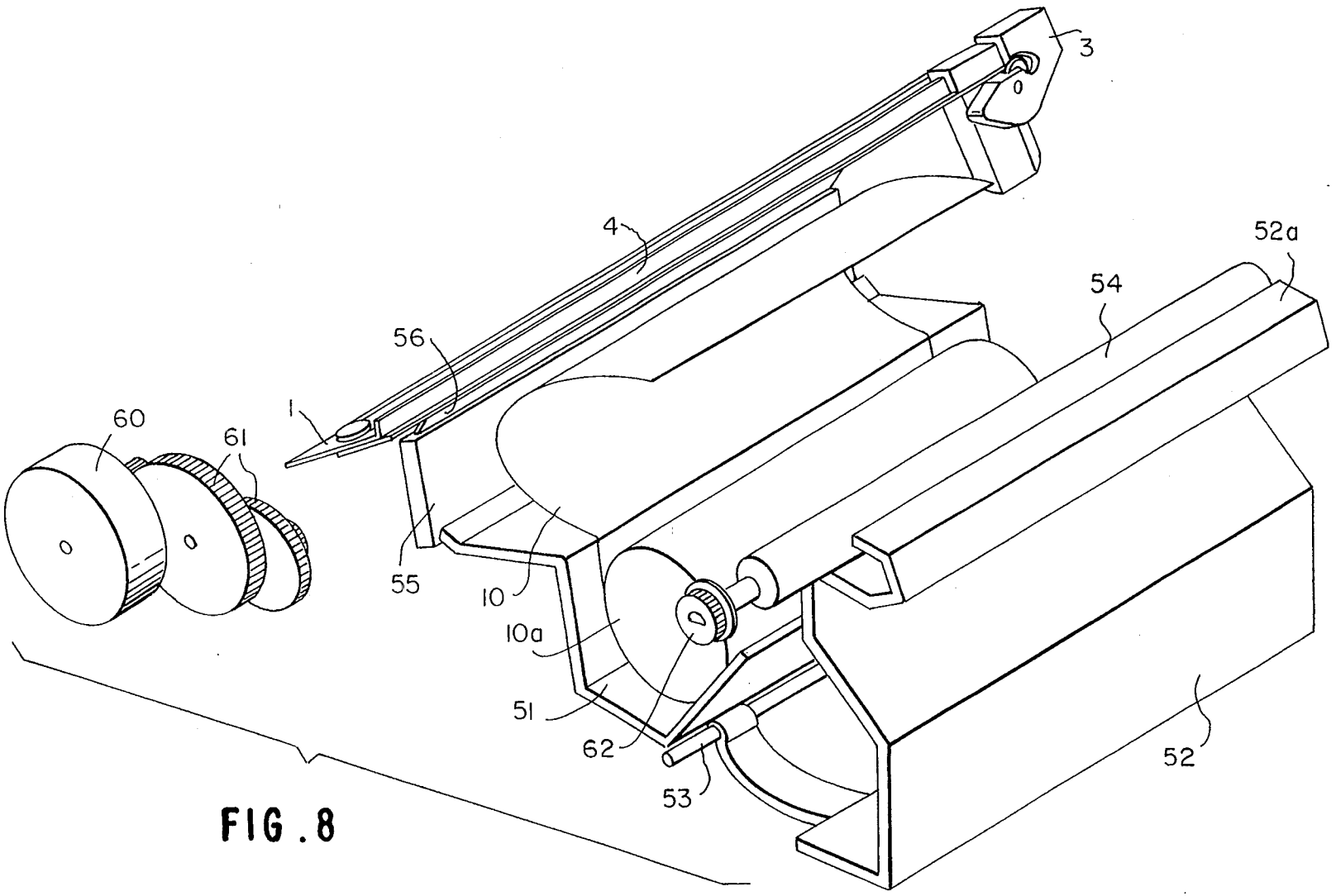
FIG. 8 is a perspective view showing the positioning of the paper in the recording device of FIG. 6.

When the paper roll 10*a* is positioned in the case 51, the disk head carriage 3 is disposed in the home position and the cover 52 along with the platen roller 54 is pivoted to an opened position as shown in FIG. 8. After the paper 10 is discharged from the roll 10*a*, the cover 52 is closed and the gear 62 is engaged with a gear 61. Then, a cutting operation is performed to cut an end portion of the paper 10. During the cutting operation, the front plow portion 33*a* of the arm 33 guides the side edge of the paper 10 to the cutting position between the stationary cutter 2 and cutting wheel 5 as described above. Therefore, it is not necessary to retain the paper 10 in a narrow gap, as in the conventional arrangement. This prevents the paper 10 from jamming in the cutting device. Further, even if the paper does jam, it is easy to remove the jammed paper by simply opening the cover 52.

Figure 9:
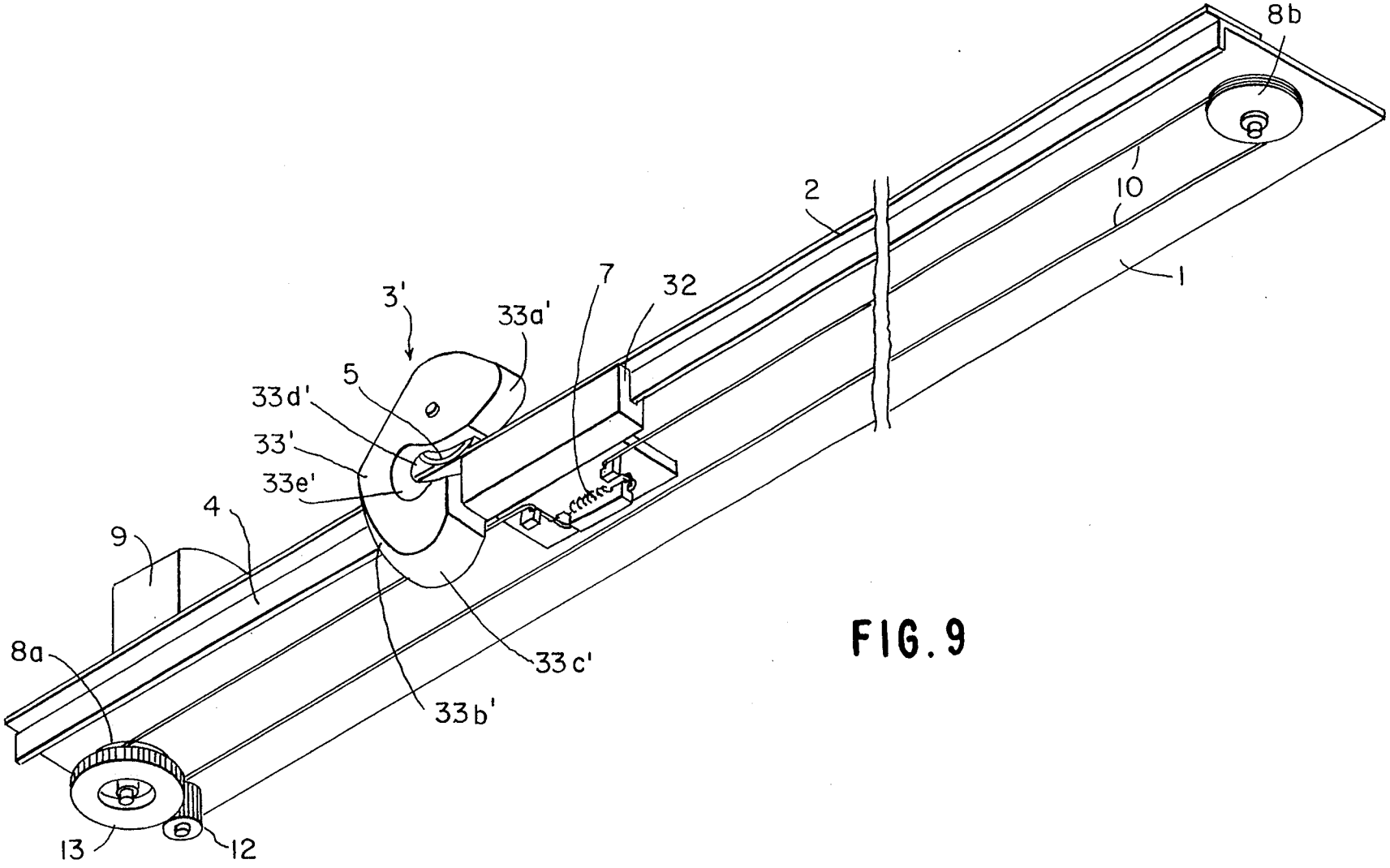
FIG. 9 is a perspective view of a paper cutting device according to a second embodiment of the present invention.

FIG. 9 shows a paper cutting device according to another embodiment of the present invention. The only difference between the paper cutting device of FIG. 9 and the paper cutting device of FIG. 4 is the shape of the cutting wheel carriage 3' and the manner in which it is operated. When the cutting device of FIG. 4 is used, paper is supplied from below the cutter frame 1 and the cut paper falls below the cutting frame 1 as shown in FIGS. 6 to 8. On the other hand, when the cutting device of FIG. 9 is used, paper is supplied from above the cutter frame 1 and the cut paper falls below the cutting frame 1. Therefore, in the cutting device of FIG. 9, the front plow portion 33*a'* of the arm 33' is positioned above the stationary cutter 2, and the rear plow portion 33*b'* and the bottom plow portion 33*c'* of the arm 33' are positioned below the stationary cutter 2. Each of the plow portions in FIG. 4 and FIG. 9 performs the same function.

Figure 10:
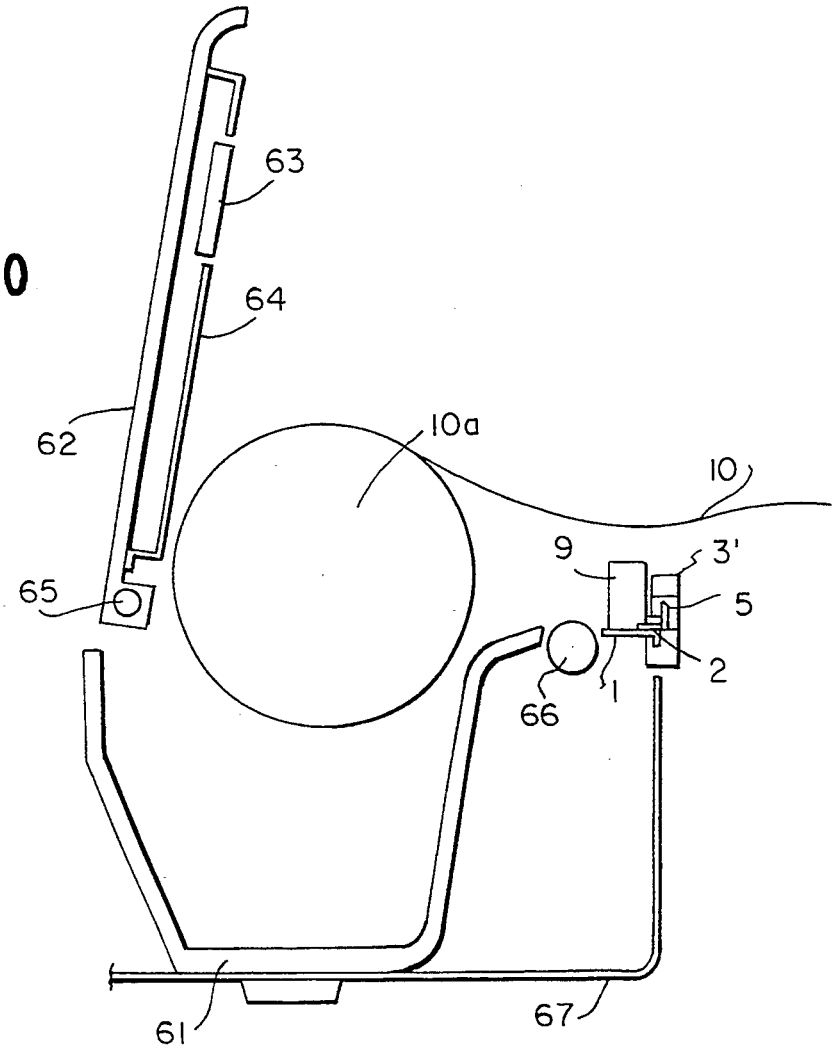
FIG. 10 is a sectional view of a recording device of a facsimile machine which includes the paper cutting device of FIG. 9.
Figure 11:
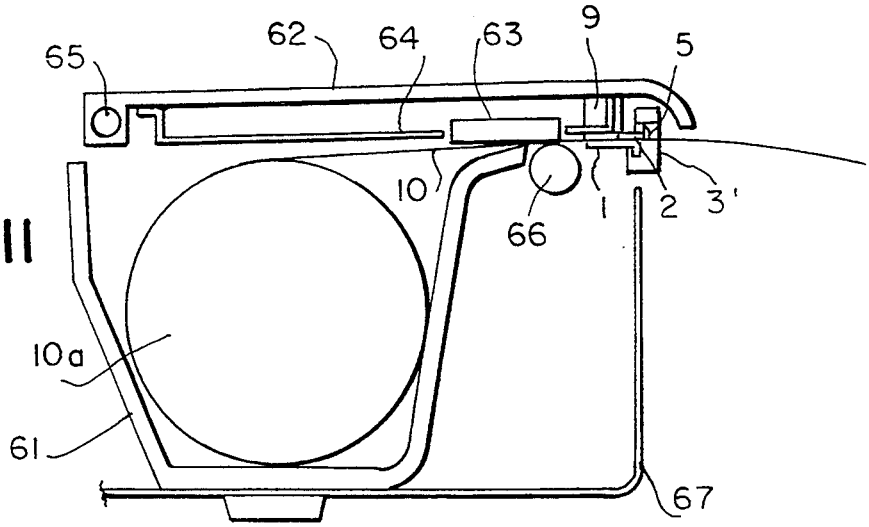
FIG. 11 is a sectional view of the recording device of FIG. 10 after the paper has been positioned in the recording device.

FIG. 10 and FIG. 11 show a recording mechanism for a facsimile machine which uses the cutting device of FIG. 9.

A thermal sensing paper roll 10*a* is placed in a case 61 which is fixed on a housing 67. A cover 62 is disposed on the case 61 and rotates about an axis 65 between opened and closed positions. A thermal head 63 is disposed inside the cover 62 and is supported by support 64. When the cover 62 is closed as shown in FIG. 11, the thermal head 63 contacts a platen roller 66 which is located between the upper part of the case 61 and the cutting device. The paper 10 discharged from the paper roll 10*a* is nipped between the thermal head 63 and the platen roller 66, and then fed along the cutter frame 1 of the cutting device. Before the cutting operation, the carriage 3' is disposed at the home position on the motor side. Then the carriage 3', and attendantly the cutting wheel 5, moves along the stationary cutter 2 to cut the paper 10. Since the edge of the paper 10 is guided toward the cutting position by the front plow portion 33*a'*, the cutting operation is performed without experiencing paper jam. Also the curved concave portion 33*d'* and the curved surface 33*e'* separate the cut paper from the arm 33' in the same manner discussed above. When the carriage 3' reaches the opposite end from the home position, it returns to the home position and plow portion 33*b'* and bottom plow portion 33*c'* urge the cut paper downwardly.

In the above embodiments, a moving device for moving the carriage 3 or 3' in a reciprocating motion along the guide rail 4 is implemented by the wire 10 passing over the two pulleys at longitudinal opposite ends of the stationary cutter 2. If desired, the pulleys and the wire 10 may be replaced with gears and a timing belt, respectively. Alternatively, the pulleys and the wire 10 may be replaced with a screw gear shaft which is disposed parallel to the stationary cutter 2. When the screw gear shaft is used as the moving device, the carriage 3 is coupled to the screw gear shaft via a coupling gear and is moved by rotating the screw gear shaft. This mechanism is used in a moving device for moving a printer head carriage.

Also, although the preferred embodiment uses a rotary cutting wheel 5 as the movable cutter, another movable cutter may be used.

Although the present invention has been fully described by way of the preferred embodiments thereof with reference to the accompanying drawings, various changes and modifications will be apparent to those having skill in this field. Therefore, unless these changes and modifications otherwise depart from the scope of the present invention, they should be construed as included therein.

What is claimed is:

1. A paper cutting device for cutting paper comprising:

a stationary cutter extending along a lateral direction of the paper and having a stationary cutting edge;

a movable cutter movable along said stationary cutter and having a movable cutting edge which, in cooperation with said stationary cutting edge, cut said paper at a cutting position of the movable cutting edge;

a movable carriage which includes an arm disposed in front of an edge of said stationary cutter and rotatably supporting said movable cutter, a plow portion formed with said arm and having means for guiding the paper to the cutting position, and a separating portion, formed with said arm, through which a cut portion of said paper is fed to separate from an uncut portion; and moving means, disposed on a surface of said stationary cutter and connected to said arm, for moving said movable carriage along said stationary cutter, said movable cutter and said plow portion being disposed proximate to an opposite side of said surface on which said moving means are disposed.

2. The paper cutting device claimed in claim 1, wherein said separating portion has an inclined curved concave surface which faces in a direction which is outwardly inclined with respect to said stationary cutting edge.

3. The paper cutting device claimed in claim 1, wherein said plow portion is a first plow portion and said arm further comprises a second plow portion disposed near a bottom of said arm and having means for urging the cut portion of said paper from a remaining portion of said paper upon a return stroke of said carriage.

4. The paper cutting device claimed in claim 3, wherein said first plow portion and said second plow portion of said arm are located lower than said stationary cutter.

5. The paper cutting device claimed in claim 3, wherein said first plow portion and said second plow portion of said arm are located on opposite sides with respect to said stationary cutter.

6. The paper cutting device as claimed in claim 1, wherein said movable cutter is a rotary cutting wheel which is rotatably mounted to said arm.

7. The cutting device claimed in claim 6, further comprising rotating means for rotating said cutting wheel in response to movement of said carriage by said moving means.

8. The cutting device claimed in claim 7, wherein said rotating means includes a pressure wheel integral to said cutting wheel and disposed such that a peripheral edge of said pressure wheel is urged against said stationary cutter.

9. The paper cutting device claimed in claim 1, further comprising a cutter frame to which said stationary cutter and said moving means are secured.

10. The paper cutting device claimed in claim 9, wherein said cutter frame has a guide constructed in parallel to said stationary cutter for guiding said movable carriage.

11. The cutting device claimed in claim 10, wherein said moving means comprises a pair of pulleys coupled to said cutter frame, a wire held between said pulleys, and drive means for rotating one of said pulleys so as to move said wire, said movable carriage being fixed to said wire.

* * * * *